US012594593B2

(12) United States Patent
Aoki et al.

(10) Patent No.: US 12,594,593 B2
(45) Date of Patent: Apr. 7, 2026

(54) PRODUCTION METHOD FOR RING-ROLLED MATERIAL OF Fe—Ni-BASED SUPERALLOY

(71) Applicant: PROTERIAL, LTD., Tokyo (JP)

(72) Inventors: Chuya Aoki, Tokyo (JP); Tsuyoshi Fukui, Tokyo (JP); Daigo Ohtoyo, Tokyo (JP); Etsuo Fujita, Tokyo (JP); Naoyuki Iwasa, Tokyo (JP); Taku Hirosawa, Tokyo (JP)

(73) Assignee: PROTERIAL, LTD., Tokyo (JP)

( * ) Notice: Subject to any disclaimer, the term of this patent is extended or adjusted under 35 U.S.C. 154(b) by 678 days.

(21) Appl. No.: 17/276,346

(22) PCT Filed: Sep. 19, 2019

(86) PCT No.: PCT/JP2019/036757
§ 371 (c)(1),
(2) Date: Mar. 15, 2021

(87) PCT Pub. No.: WO2020/059798
PCT Pub. Date: Mar. 26, 2020

(65) Prior Publication Data

US 2022/0032359 A1 Feb. 3, 2022

(30) Foreign Application Priority Data

Sep. 19, 2018 (JP) ..... 2018-174961

(51) Int. Cl.
*B21H 1/06* (2006.01)
*B21J 1/06* (2006.01)
(Continued)

(52) U.S. Cl.
CPC ..... *B21H 1/06* (2013.01); *B21J 1/06* (2013.01); *C22C 19/056* (2013.01); *C22F 1/10* (2013.01)

(58) Field of Classification Search
CPC ..... C22C 19/056; B21H 1/06; B21J 1/06
See application file for complete search history.

(56) References Cited

U.S. PATENT DOCUMENTS 6,409,853 B1 6/2002 Thamboo et al.
2011/0158844 A1* 6/2011 Ohsone ..... F01D 5/28 420/586.1
(Continued)

FOREIGN PATENT DOCUMENTS

EP 1094127 A2 4/2001
EP 2979774 A1 2/2016
(Continued)

OTHER PUBLICATIONS

"Communication with Supplementary European Search Report", EP Application No. 19863194.7, May 19, 2022, 23 pp.
(Continued)

*Primary Examiner* — Christopher L Templeton
*Assistant Examiner* — P Derek Pressley
(74) *Attorney, Agent, or Firm* — Myers Bigel, P.A.

(57) ABSTRACT

A method for producing a ring-rolled material of an Fe—Ni based superalloy, which has a high circularity, can inhibit AGG, and can inhibit grain growth. A method for producing a ring-rolled material of an Fe—Ni based superalloy having a composition of an Alloy 718 comprises: a finishing ring rolling step of heating a ring-shaped material for ring rolling having the composition, in a temperature range of 900° C. to 980° C., and performing finishing ring rolling; and a circularity correcting step of correcting an ellipticalness of the ring-rolled material that has been rolled in the finishing ring rolling step, while expanding a diameter of the ring-rolled material by using a ring expander including a pipe-expanding cone and a pipe-expanding die, wherein the ring-rolled material that has been rolled in the finishing ring rolling step
(Continued)

is subjected to circularity correction without being reheated or after having been heated to up to 960° C.

4 Claims, 1 Drawing Sheet

(51) Int. Cl.
*C22C 19/05* (2006.01)
*C22F 1/10* (2006.01)

(56) References Cited

U.S. PATENT DOCUMENTS

| | | | | |
|---|---|---|---|---|
| 2016/0271681 | A1* | 9/2016 | Yagami | F01D 5/02 |
| 2017/0114435 | A1* | 4/2017 | Aoki | C22F 1/10 |

FOREIGN PATENT DOCUMENTS

| | | | | |
|---|---|---|---|---|
| EP | 3128037 | A1 | | 2/2017 |
| JP | 2011079043 | A | | 4/2011 |
| JP | 2014184449 | A | * | 10/2014 |
| JP | 2015199121 | A | | 11/2015 |
| JP | 5994951 | B2 | | 9/2016 |
| KR | 20120017896 | A | | 2/2012 |

OTHER PUBLICATIONS

Allwood, Julian M., et al., "The Development of Ring Rolling Technology", Steel Research International, vol. 76, No. 2/3, Feb. 1, 2005, pp. 111-120.

Allwood, Julian M., et al., "The Development of Ring Rolling Technology—Part 2: Investigation of Process Behaviour and Production Equipment", Steel Research International, vol. 76, No. 7, Jul. 2005, pp. 491-507.

"International Search Report—English language translation", International Application No. PCT/JP2019/036757, Nov. 12, 2019.

* cited by examiner

PRODUCTION METHOD FOR RING-ROLLED MATERIAL OF Fe—Ni-BASED SUPERALLOY

RELATED APPLICATIONS

This application is a 35 U.S.C. § 371 national stage application of PCT Application No. PCT/JP2019/036757, filed on Sep. 19, 2019, which claims priority from Japanese Patent Application No. 2018-174961, filed on Sep. 19, 2018, the contents of which are incorporated herein by reference in their entireties. The above-referenced PCT International Application was published in the Japanese language as International Publication No. WO 2020/059798 A1 on Mar. 26, 2020.

TECHNICAL FIELD

The present invention relates to a method for producing a ring-rolled material of an Fe—Ni based superalloy.

BACKGROUND ART

Alloy 718 is a superalloy which has excellent mechanical properties, and accordingly, has been most widely used for turbine parts of aircraft engines. Because a high fatigue strength is required for rotating parts formed from Alloy 718 which is used for aircraft engines, the Alloy 718 constituting the parts is required to have a fine-grained structure. For example, in the case of a ring-shaped rotating part, usually, a billet is prepared from an ingot, and then this is subjected to hot forging, ring rolling, and closed die forging; and a fine-grained structure is created in the rotating part, for which a pinning effect of a delta phase is made use of. On the other hand, from the viewpoint of production cost, it is desirable that a converted shape by closed die forging be a shape in which excess thickness for a product is made as thin as possible, and for this reason, a particularly high circularity is required for the ring-shaped material for closed die forging, which is supplied to the closed die forging.

However, when the ring-shaped material for the closed die forging is prepared, if circularity correction is performed in order to obtain a high degree of circularity, there is a case in which so-called abnormal grain growth (hereinafter referred to as "AGG" in some cases) is caused, which is a phenomenon in which while the material is subsequently heated to a closed die forging temperature, the grains rapidly become coarse beyond the pinning of the delta phase. Due to the occurrence of the AGG, there is a case in which the grain size becomes coarser by 10 times or more; and the grain cannot be completely refined in the closed die forging step, and as a result, a problem arises in that coarse grains remain in the product, and fatigue properties are greatly impaired. As a method for avoiding the AGG, in Patent Document 1, for example, it is described that a condition is effective as a condition of hot working, which satisfies the following Expression (1) or (2) between an effective strain and an effective strain rate.

$$[\text{effective strain}] \geq 0.139 \times [\text{effective strain rate (/sec)}]^{-0.30} \quad (1)$$

$$[\text{effective strain}] \leq 0.017 \times [\text{effective strain rate (/sec)}]^{-0.34} \quad (2)$$

REFERENCE DOCUMENT LIST

Patent Document

Patent Document 1: JP 5994951 B

SUMMARY OF THE INVENTION

Problem to be Solved by the Invention

The invention described in Patent Document 1 is excellent in that the AGG can be prevented by the condition represented by Expression (1) or (2), in the first hot working. However, it is not practical from the viewpoint of the pressing capability to apply the effective strain satisfying Expression (1) to the entire region of the ring-shaped material for the closed die forging, only by the step of the circularity correction. On the other hand, it is difficult to control the application of the effective strain satisfying Expression (2) to the ring-shaped material for the closed die forging, because the strain remaining in the ring-rolled material at the end of ring rolling is not uniform. Thus, even though ways of preventing the AGG independently by each of the two steps of the ring rolling step and the circularity correcting step have been considered, it has been difficult to solve the problem of the occurrence of AGG during heating of the closed die to the forging temperature.

An object of the present invention is to provide a method for producing a ring-rolled material of an Fe—Ni based superalloy, which has a high circularity, can inhibit AGG, and can inhibit grain growth.

Means for Solving the Problem

The present invention has been made in light of the problem described above.

Specifically, the present invention provides a method for producing a ring-rolled material of an Fe—Ni based superalloy having a composition including, by mass %, up to 0.08% of C, 50.0 to 55.0% of Ni, 17.0 to 21.0% of Cr, 2.8 to 3.3% of Mo, 0.20 to 0.80% of Al, 0.65 to 1.15% of Ti, 4.75 to 5.50% of Nb+Ta, up to 0.006% of B, and the balance of Fe with inevitable impurities, with use of ring rolling, the production method comprising:

a finishing ring rolling step, as a final step of the ring rolling, of heating a material for ring rolling in a temperature range of 900 to 980° C., and expanding a diameter of the material for ring rolling and also pressing the material for ring rolling in an axial direction thereof, by using a ring rolling mill having a pair of rolling rolls including a main roll and a mandrel roll, and a pair of axial rolls; and a circularity correcting step of improving a circularity of a ring-rolled material that has been rolled by the finishing ring rolling step, while expanding a diameter of the ring-rolled material by using a ring expander including a pipe-expanding cone and a pipe-expanding die, wherein the ring-rolled material that has been rolled by the finishing ring rolling step is subjected to the circularity correcting step without being reheated, or the ring-rolled material that has been rolled in the finishing ring rolling step is subjected to the circularity correcting step in a temperature range of up to 960° C. excluding a temperature range of 600 to 760° C.

In addition, it is preferable that the present invention further comprise an intermediate ring rolling step, as a pre-step of the finishing ring rolling step, of heating the material for ring rolling to a temperature range of higher than 980° C. and up to 1010° C., and expanding a diameter of the material for ring rolling that has been heated to the temperature range and also pressing the material for ring rolling in an axial direction thereof by using a ring rolling mill having a pair of rolling rolls including a main roll and a mandrel roll, and a pair of axial rolls.

Effects of the Invention

According to the present invention, the ring-rolled material of the Fe—Ni based superalloy can be obtained, which has a high circularity, inhibits AGG, and inhibits grain growth. Furthermore, in the present invention, after the finishing ring rolling step has ended, it is possible to make use of the heat retained in the ring-rolled material as it is and perform the circularity correcting step without performing reheating, accordingly which is economically advantageous. For example, the reliability for the fatigue characteristics of the turbine parts and the like of aircraft engines can be improved, for which this ring-rolled material is used.

MODE FOR CARRYING OUT THE INVENTION

Figure 1:
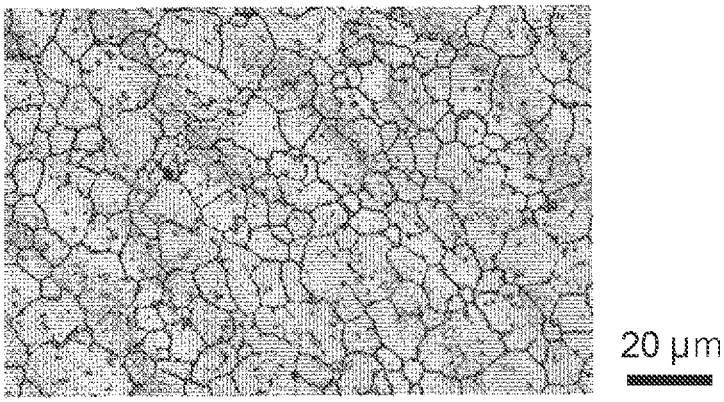
FIG. 1 is a photograph of the microstructure of a ring-rolled material to which a method for producing the ring-rolled material of the present invention has been applied.

The most significant characteristic of the present invention is in preventing AGG by optimizing conditions of a ring rolling step and a circularity correcting step of a ring-rolled material. The AGG occurs in heat treatment after low strain has been applied to an initial state in which no strain remains. The technical concept of the present invention for inhibiting the occurrence of the AGG is as follows.

The technical concept is that if circularity correction (low strain application) is performed in a state in which strain is sufficiently stored in the ring-rolled material, the influence of the low strain can be made harmless. In addition, the technological idea is to optimize the microstructure by heating the ring-rolled material obtained in the present invention at 980 to 1010° C. before hot forging.

The alloy composition prescribed in the present invention is known as that of an NCF718 alloy (Fe—Ni based superalloy) according to JIS-G4901, and accordingly, description of the composition will be omitted. Hereinafter, the NCF718 alloy will be simply referred to as "Alloy 718". The composition of the Alloy 718 can include elements in a range of up to 0.35% of Si, up to 0.35% of Mn, up to 0.015% of P, up to 0.015% of S, and up to 0.30% of Cu, in addition to each element which is prescribed in the present invention.

Ring Rolling Step

Firstly, the "finishing ring rolling step" will be described which is characteristic in the present invention. The "finishing ring rolling step" is a final ring rolling step.

A material for ring rolling for the finishing ring rolling step is prepared, which has a composition of the Alloy 718, and the material for ring rolling is heated in a temperature range of 900 to 980° C. Then, by using a ring rolling mill which has a pair of rolling rolls composed of a main roll and a mandrel roll and a pair of axial rolls, the finishing ring rolling is performed which expands a diameter of the heated material for ring rolling and also presses the material for ring rolling in its axial direction.

The occurrence of the AGG in the Alloy 718 was confirmed as a phenomenon in which when a low strain is introduced into the Alloy 718 having a fine-grained structure, grains remarkably grow beyond pinning during subsequent heat treatment. As described above, it is practically difficult to introduce sufficient strain for avoiding the occurrence of the AGG only by the step of correcting the circularity of the ring-rolled material, also from the viewpoint of the pressing capability. However, the occurrence of the AGG can be prevented if the circularity is corrected in a state in which sufficient strain has been stored in the ring-rolled material in the finishing ring rolling. Accordingly, in the finishing ring rolling step, the heating temperature of the material for ring rolling is set to a range of 900 to 980° C., and the ring-rolled material is subjected to the ring rolling. Thereby, the recrystallization during the ring rolling is inhibited, the ring-rolled material at the time when the ring rolling has ended is controlled to have an unrecrystallized or partially recrystallized structure therein, and the strain remains in the ring-rolled material. If the heating temperature exceeds 980° C., the recrystallization during the ring rolling is promoted, and the strain cannot be sufficiently stored in the ring-rolled material. On the other hand, if the heating temperature is lower than 900° C., the recrystallization is almost completely inhibited, but the rolling load becomes remarkably high, which makes the ring rolling difficult. Accordingly, the heating temperature of the material for ring rolling is set to 900 to 980° C. The lower limit of the heating temperature is preferably 910° C., and more preferably 920° C. The upper limit of the heating temperature is preferably 970° C., and more preferably 965° C.

The ring rolling step may be repeated after reheating. In this case, an "intermediate ring rolling step" may be applied as a pre-step of the finishing ring rolling step.

The reason the heating temperature in the intermediate ring rolling step is set to a range of higher than 980° C. to up to 1010° C. is to obtain a sufficient recrystallized structure. In a temperature range of up to 980° C., it becomes difficult to obtain sufficient recrystallization, and if the temperature exceeds 1010° C., the grains tend to become coarse. The lower limit of the heating temperature in the intermediate ring rolling step is preferably 985° C., and it is preferable to perform the ring rolling step at a temperature higher than in the finishing ring rolling step by at least 10° C. It is also acceptable to subject the material for ring rolling heated at a heating temperature of the intermediate ring rolling step to the intermediate ring rolling, thereby create a fine-grained structure therein due to promoted recrystallization, and set a heating temperature at the time of final (finish) ring rolling to a temperature range of 900 to 980° C., and perform the final ring rolling. In other words, in a case in which heating and ring rolling are performed a plurality of times, it is acceptable to heat the material for ring rolling in a temperature range of 900 to 980° C. at the time when the final (finish) ring rolling is performed.

Circularity Correcting Step

The circularity correction is performed for correcting an ellipticalness by using the ring expander which includes the pipe-expanding cone and the pipe-expanding die, and expanding a diameter of the ring-rolled material, while pressing the pipe-expanding die against the inner diameter side of the ring-rolled material that has been rolled in the above ring rolling step. At this time, the ring-rolled material that has been rolled in the ring rolling step is subjected to the circularity correction without being reheated or is subjected to the circularity correction in a temperature range of up to 960° C.

The strain remains in the ring-rolled material in the above ring rolling step, and accordingly, the low strain, which has been introduced in the circularity correcting step, can be made harmless. Accordingly, the ring-rolled material in a high-temperature state after the ring rolling may be immediately subjected to the circularity correction, or alternatively, may be subjected to the circularity correction after the ring-rolled material has been cooled to room temperature. In other words, the ring-rolled material which has been rolled in the ring rolling step can be subjected to the circularity correction without being reheated. Furthermore, the ring-rolled material which has been rolled in the ring rolling step may be subjected to the circularity correction alternatively after having been heated at up to 960° C. In a case in which the circularity correction is performed after reheating, attention should be paid to the selection of the heating temperature in terms of inhibiting the occurrence of recrystallization. When recrystallization occurs, the strain stored by ring rolling is reduced, and accordingly, a risk of occurrence of the AGG increases, which originates in the low strain that shall be introduced in subsequent circularity correction. For the above reason, in a case in which the ring-rolled material is reheated, the heating temperature is set to up to 960° C., which avoids the aging temperature range of 600 to 760° C. The reheating temperature is preferably up to 950° C., and more preferably up to 940° C. In addition, the circularity correcting step may be performed, for example, at a temperature near ordinary temperature, but in a case of the circularity correction at an excessively low temperature, the rolling load necessary for plastic deformation becomes excessively high. Accordingly, it is acceptable to perform the circularity correction at a temperature as high as possible, and it is preferable to perform the circularity correction following the end of the ring rolling step described above. In order not to excessively increase the rolling load, the circularity correction is performed preferably at a temperature in a range of higher than 760° C., and more preferably 800° C. or higher.

Due to the circularity correcting step, the circularity of the ring-rolled material can be controlled to up to 3 mm. The circularity is determined by $(D_{MAX}-D_{MIN})/2$ [mm] (where $D_{MAX}$ is the maximum value of an outer diameter of the ring after the circularity correction and $D_{MIN}$ is the minimum value of an outer diameter of the ring after the circularity correction).

When the above ring-rolled material of the present invention is used as a material for hot forging, and pre-forging heating at 980 to 1010° C. is applied thereto, such a microstructure can be formed so as to inhibit the occurrence of the AGG and the grain growth. The lower limit of the heating temperature before forging is preferably 985° C., and more preferably 990° C. The upper limit of the heating temperature is preferably 1005° C., and more preferably 1000° C.

In addition, the ring-rolled material has high circularity, and accordingly is suitable as a material for hot forging for closed die forging.

EXAMPLES

Example 1

A ring-shaped material for ring rolling was obtained which was prepared by subjecting a billet having a chemical composition shown in Table 1, which corresponded to that of an Fe—Ni based superalloy (Alloy 718), to hot forging in a temperature range of 980 to 1010° C., and then to piercing. This material for ring rolling was heated at a heating temperature in a range of higher than 980° C. to up to 1000° C., and was subjected to the intermediate ring rolling. Next, the ring-rolled material was heated at a heating temperature in a range of 920 to 980° C., and was then subjected to the finishing ring rolling; and a ring-rolled material was obtained which had an outer diameter of approximately 1300 mm, an inner diameter of approximately 1100 mm, and a height of approximately 200 mm. The obtained ring-rolled material was slightly elliptical. The circularity exceeded about 3 mm.

After the end of the finishing ring rolling, the ring-rolled material was immediately conveyed to a ring expander including a pipe-expanding cone and a pipe-expanding die without being reheated, and was subjected to the circularity correction with the use of the ring expander so that the diameter expansion amount was in a range of 5 to 10 mm. This process of the present invention is referred to as "Direct" in the following Table 2. In the Examples shown as "Direct", the temperature at which the circularity correction was performed was about 800 to 850° C. The circularity of the ring-rolled material was 0.5 mm after the circularity correction. Examples of the present invention (Nos. 1 to 4) were prepared by being subjected to heating for the closed die forging at 1000° C. for 3 hours, after the circularity correction. For comparison, Comparative Examples (Nos. 11 to 13) were prepared in which the heating temperatures of the materials for ring rolling to be subjected to the finishing ring rolling were changed, and temperatures for heating the ring-rolled materials to be subjected to the circularity correction were changed. The heating temperatures are shown in Table 2.

The ring rolling mill which was used for producing the ring-rolled material has a function of expanding the inner diameter and the outer diameter of the material for ring rolling, by the pair of rolling rolls composed of the main roll and the mandrel roll, and pressing the material for ring rolling in its height (thickness) direction by the pair of axial rolls.

TABLE 1

| C | Ni | Cr | Mo | Al | Ti | Nb | B | (mass %) Balance |
|---|---|---|---|---|---|---|---|---|
| 0.023 | 54.9 | 17.97 | 2.98 | 0.48 | 0.95 | 5.44 | 0.0029 | Fe with inevitable impurities |

After the ring rolled material had been subjected to heating for the closed die forging, microstructures of the entire cross sections of the ring-rolled materials in radial directions of the rings in Examples of the present invention and Comparative Examples were observed with an optical microscope. The grain size number was measured according to the method defined in ASTM E112, and the results are shown in Table 2.

Figure 2:
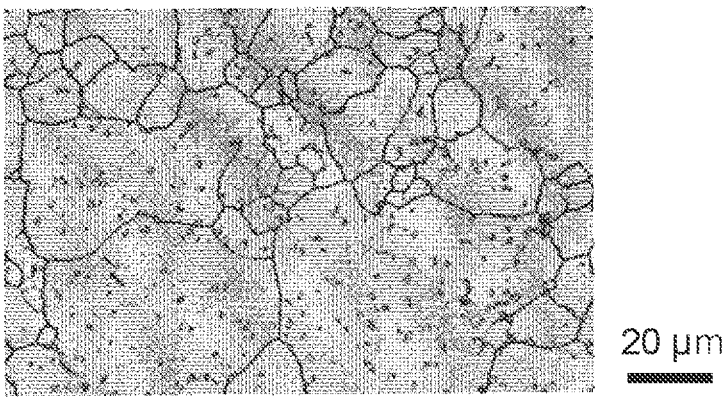
FIG. 2 is a photograph of the microstructure of a ring-rolled material of a Comparative Example in which abnormal grain growth has occurred.

As is shown in Table 2, in Nos. 1 to 4 of the present invention, a fine-grained structure is obtained which has a grain size number of at least 8, after heating at 1000° C. which assumes the closed die forging. In No. 4 of the present invention, the grain size number was mainly 8.5 to 9, but on the other hand, in Nos. 1 to 3, the grain size number was mainly 9 to 9.5. By using such a uniform fine-grained material, a good microstructure can be obtained even after die forging for forming a final product. On the other hand, in Nos. 11 to 13 of Comparative Examples, a large number of coarse grains were observed which had a grain size number of up to 6. It is considered that in the Comparative Examples, the finishing rolling temperature was high, and accordingly recrystallization occurred during rolling, and thereby the strain was released, and the AGG occurred due to the low strain which was introduced in the subsequent circularity correction. In No. 14, the finishing rolling was performed at the finishing rolling temperature in a temperature range of the present invention, but it is considered that the heating temperature for the circularity correction was as high as 965° C., accordingly recrystallization occurred, and thereby the amount of strain decreased, and the AGG occurred due to the strain which was introduced in the subsequent correction. FIG. 1 shows a photograph of the microstructure of No. 1 in Examples of the present invention, and FIG. 2 shows a photograph of the microstructure of Comparative Example No. 11.

TABLE 2

| No. | Finishing ring rolling | Circularity correction | Grain size after heating at 1000° C. | Remarks |
|---|---|---|---|---|
| 1 | 920° C. | Direct | GS# 8-10.5 | Example of present invention |
| 2 | 950° C. | Direct | GS# 8-10.5 | Example of present invention |
| 3 | 965° C. | Direct | GS# 8-10.5 | Example of present invention |
| 4 | 980° C. | Direct | GS# 8-10.5 | Example of present invention |
| 11 | 990° C. | 900° C. | Occurrence of large numbers of GS# 6 or less | Comparative Example |
| 12 | 990° C. | 980° C. | Occurrence of large numbers of GS# 6 or less | Comparative Example |
| 13 | 1010° C. | 990° C. | Occurrence of large numbers of GS# 6 or less | Comparative Example |
| 14 | 965° C. | 965° C. | Occurrence of large numbers of GS# 6 or less | Comparative Example |

As described above, it is understood that when the production method of the present invention is applied, a ring-rolled material of an Fe—Ni based superalloy can be obtained which has high circularity, inhibits AGG, and has a fine-grained structure of at least No. 8 in ASTM grain size number. As a result, the above ring-rolled material of the Fe—Ni based superalloy can improve the reliability for fatigue characteristics of turbine parts and the like of aircraft engines.

The invention claimed is:

1. A method for producing a ring-rolled material of an Fe—Ni based superalloy having a composition including, by mass %, up to 0.08% of C, 50.0 to 55.0% of Ni, 17.0 to 21.0% of Cr, 2.8 to 3.3% of Mo, 0.20 to 0.80% of Al, 0.65 to 1.15% of Ti, 4.75 to 5.50% of Nb+Ta, up to 0.006% of B, and the balance of Fe with inevitable impurities, using ring rolling, the method comprising:

a finishing ring rolling step, as a final step of the ring rolling, of heating a ring-shaped material for ring rolling to a temperature range of 900 to 970° C. and then maintaining the ring-shaped material for ring rolling in a temperature range of 900 to 970° C. while expanding a diameter of the ring-shaped material for ring rolling and also pressing the ring-shaped material for ring rolling in an axial direction thereof, by using a ring rolling mill having a pair of rolling rolls including a main roll and a mandrel roll, and a pair of axial rolls to inhibit recrystallization in the material for ring rolling and to obtain a ring-shaped ring-rolled material having an unrecrystallized or partially recrystallized structure and storing sufficient strain for avoiding an occurrence of abnormal grain growth (AGG) during hot forging after a circularity correcting step;

a circularity correcting step of improving a circularity of a the ring-shaped ring-rolled material by expanding a diameter of the ring-shaped ring-rolled material by using a ring expander including a pipe-expanding cone and a pipe-expanding die to press the pipe-expanding die against an inner diameter side of the ring-shaped ring-rolled material, the circularity being determined by $(D_{MAX}-D_{MIN})/2$ [mm], wherein $D_{MAX}$ is a maximum value of outer diameters of the ring-shaped ring-rolled material after the circularity correcting step, and $D_{MIN}$ is a minimum value of the outer diameter of the ring-shaped ring-rolled material after the circularity correcting step; and an intermediate ring rolling step, as a pre-step of the finishing ring rolling step, of heating the material for ring rolling to a temperature range of higher than 980° C. and up to 1010° C., and expanding a diameter of the material for ring rolling that has been heated at the temperature range and also pressing the material for ring rolling in an axial direction thereof by using a ring rolling mill having a pair of rolling rolls including a main roll and a mandrel roll, and a pair of axial rolls to have a fine-grained structure in the material for ring rolling by promoting recrystallization, wherein the ring-shaped ring-rolled material that has been rolled in the finishing ring rolling step is subjected to the circularity correcting step in a temperature range of 800 to 850° C. without being reheated.

2. The method for producing a ring-rolled material of an Fe—Ni based superalloy according to claim 1, further comprising optimizing a microstructure in a circularity-corrected material after the circularity correcting step by heating the circularity-corrected material to a temperature range of 980 to 1010° C. before hot forging the circularity-corrected material.

3. A method for producing a ring-rolled material of an Fe—Ni based superalloy having a composition including, by mass %, up to 0.08% of C, 50.0 to 55.0% of Ni, 17.0 to 21.0% of Cr, 2.8 to 3.3% of Mo, 0.20 to 0.80% of Al, 0.65 to 1.15% of Ti, 4.75 to 5.50% of Nb+Ta, up to 0.006% of B, and the balance of Fe with inevitable impurities, using ring rolling, the method comprising:

a finishing ring rolling step, as a final step of the ring rolling, of heating a ring-shaped material for ring rolling to a temperature range of 900 to 970° C. and then maintaining the ring-shaped material for ring rolling in a temperature range of 900 to 970° C., while expanding a diameter of the ring-shaped material for ring rolling and also pressing the ring-shaped material for ring rolling in an axial direction thereof, by using a ring rolling mill having a pair of rolling rolls including a main roll and a mandrel roll, and a pair of axial rolls to inhibit recrystallization in the material for ring rolling and to obtain a ring-shaped ring-rolled material having an unrecrystallized or partially recrystallized structure and storing sufficient strain for avoiding an occurrence of abnormal grain growth (AGG) therein during a circularity correcting step described below;

a circularity correcting step of improving a circularity of the ring-shaped ring-rolled material by expanding a diameter of the ring-shaped ring-rolled material by using a ring expander including a pipe-expanding cone and a pipe-expanding die to press the pipe-expanding die against an inner diameter side of the ring-shaped ring-rolled material, the circularity being determined by $(D_{MAX}-D_{MIN})/2$ [mm], wherein $D_{MAX}$ is a maximum value of outer diameters of the ring-shaped ring-rolled material after the circularity correcting step, and $D_{MIN}$ is a minimum value of the outer diameter of the ring-shaped ring-rolled material after the circularity correcting step; and an intermediate ring rolling step, as a pre-step of the finishing ring rolling step, of heating the material for ring rolling to a temperature range of higher than 980° C. and up to 1010° C., and expanding a diameter of the material for ring rolling that has been heated at the temperature range and also pressing the material for ring rolling in an axial direction thereof by using a ring rolling mill having a pair of rolling rolls including a main roll and a mandrel roll, and a pair of axial rolls to have a fine-grained structure in the material for ring rolling by promoting recrystallization, wherein the ring-shaped ring-rolled material that has been rolled in the finishing ring rolling step is subjected to the circularity correcting step after being reheated in a temperature range of up to 960° C. excluding a temperature range of 600 to 760° C.

4. The method for producing a ring-rolled material of an Fe—Ni based superalloy according to claim 3, further comprising optimizing a microstructure in a circularity-corrected material after the circularity correcting step by heating the circularity-corrected material to a temperature range of 980 to 1010° C. before hot forging the circularity-corrected material.

* * * * *